US006457856B1

(12) United States Patent
Phillips

(10) Patent No.: US 6,457,856 B1
(45) Date of Patent: Oct. 1, 2002

(54) TEMPERATURE RESPONSIVE SELF WINDING TIMEPIECES

(76) Inventor: Steven Phillips, 996 Fairview Ave., Mount Dora, FL (US) 32757

( * ) Notice: Subject to any disclaimer, the term of this patent is extended or adjusted under 35 U.S.C. 154(b) by 0 days.

(21) Appl. No.: 09/894,712

(22) Filed: Jun. 28, 2001

Related U.S. Application Data

(63) Continuation-in-part of application No. 09/812,620, filed on Mar. 20, 2001.

(51) Int. Cl.[7] ..... G04B 25/02; G04B 27/00; G04B 5/00

(52) U.S. Cl. ..... 368/148; 368/207

(58) Field of Search ..... 368/147–154, 368/206–209; 374/142, 187, 190, 195

(56) References Cited

U.S. PATENT DOCUMENTS

| | | | | |
|---|---|---|---|---|
| 2,292,475 A | | 8/1942 | Pellaton | |
| 2,687,002 A | | 8/1954 | Nallinger | |
| 2,696,073 A | | 12/1954 | Langel | |
| 3,019,595 A | * | 2/1962 | Murrle | 368/208 |
| 3,846,973 A | * | 11/1974 | Kurita | 368/208 |
| 4,106,279 A | | 8/1978 | Piguet | |
| 4,174,607 A | | 11/1979 | Wutrich | |
| 5,119,348 A | | 6/1992 | Mathys | |
| 5,517,468 A | | 5/1996 | Inoue | |
| 5,705,770 A | | 1/1998 | Okasawara et al. | |
| 5,867,454 A | | 2/1999 | Takahashi et al. | |

* cited by examiner

*Primary Examiner*—Vit Miska
(74) *Attorney, Agent, or Firm*—Robert H. Montgomery

(57) ABSTRACT

A temperature sensitive element within a timepiece which includes a casing, movement, mainspring and a bi-directional rotation to unidirectional rotation converting mechanism for winding the mainspring where the temperature sensitive element tends to angularly deflect with change in temperature and such tendency produces energy to wind the mainspring. More specifically, the invention in one form thereof utilizes a temperature sensitive bimetallic coil, which is restrained from radial deflection and the free end moves to rotate the shaft in the self-winding mechanism and effects self-winding of the timepiece. The free end of the coil will move with change in temperature. The coil is anchored at its inner end and the other end thereof, upon movement, will drive a driver member in the form of an orbit gear. In this embodiment, the orbit gear will drive a plurality of planet gears, which drive a sun gear mounted to a shaft. The shaft of the sun gear then produces rotation of a cam which drives the bi-directional to unidirectional conversion mechanism. In another embodiment of the invention, the coil will rotate a driver member, which drives a shaft of the winding mechanism. These arrangements will provide perpetual self-winding of the watch unless the watch is stored in an environment where there is extremely low tolerance temperature control.

48 Claims, 10 Drawing Sheets

TEMPERATURE RESPONSIVE SELF WINDING TIMEPIECES

RELATED APPLICATIONS

This application is a continuation-in-part of application Ser. No. 09/812,620, filed Mar. 20, 2001.

FIELD OF THE INVENTION

This invention relates to timepieces and more particularly relates to self-winding timepieces, particularly wristwatches, which are wound in response to change in temperature and may have infinite autonomy.

BACKGROUND OF THE INVENTION

Almost all, if not all, wrist watches, other than battery powered or other electrically powered watches receive energy for winding the main spring through a main spring barrel arbor from a winding weight or rotor in the watch which rotates in either direction due to movement of the watch wearers arm and wrist. Such movement of the wearer's arm and wrist produces acceleration of the winding weight or rotor in either direction about a pivotal axis and resultant bi-directional rotation of the shaft upon which it is mounted. The bi-directional rotation of this shaft is converted to unidirectional rotation of another shaft, which in turn winds the mainspring.

A simple and common mechanism for conversion of bi-directional rotation of one shaft in a watch to unidirectional rotation of another shaft is known as a Pellaton mechanism. A Pellaton mechanism comprises a lever, which is bifurcated at one end, and the bifurcated arms are acted upon by a rotating cam or eccentric pin to produce an eccentric oscillating motion. Spring loaded pawls on the lever engage a ratchet wheel at spaced apart locations on the ratchet wheel and unidirectionally rotate the ratchet with the rocking or oscillating motion of the lever induced by the winding weight or rotor. Examples of Pellaton mechanisms are shown in U.S. Pat. Nos. 2,696,073 and 4,174,607, as well as other references. Another mechanism for such conversion is known as a wig-wag mechanism. In this mechanism, a pinion on the bi-directionally rotatable shaft drives a linearly displaceable wig-wag gear, which will engage one of two other gears dependent on the direction of rotation of the wig-wag gear. The gear arrangement is such that the mainspring barrel will always be driven in a direction to wind the mainspring.

Self-winding wrist watches generally have an autonomy or power reserve of about one and one-half to three days. The terms "autonomy" and "power reserve" refer to the time a self winding wrist watch will continue to run if fully wound, but not worn.

Attempts to lengthen power reserve time have generally focused on the storage capacity of the mainspring. A well known watch maker, Patek Philippe, has recently announced a new limited quantity wrist watch, which will run for seven days. This watch requires two mainsprings. The mechanism of U.S. Pat. No. 5,119,348 provides room for an enlarged mainspring within and coaxial with the winding weight and is stated to store energy sufficient to keep the movement running for up to eight days. The 2000, 45$^{th}$ edition of

*International Wrist Watch* magazine has reported on a wrist watch with autonomy of one thousand hours. This watch contains and extremely large mainspring and due to large power losses the time keeping is not accurate at the present time The present invention departs from prior art designs of self winding watches and focusing on the mainspring by providing a new, but one of natures oldest, energy source which gives the watch essentially infinite autonomy, so long as the watch is not left in an environment of small tolerance temperature control.

An object of this invention is to provide a new and improved self-winding timepiece having essentially infinite autonomy.

Another object of this invention is to provide a watch having a new energy source for self-winding with an energy transmission system which provides essentially infinite autonomy.

A further object of this invention is to provide a watch having a new and improved energy source, which is responsive to change in temperature to effect self-winding.

A further object of this invention is to provide a watch with an element, which has movement in response to change in temperature and mechanisms for converting such movement to rotational movement for self winding of the watch.

SUMMARY OF THE INVENTION

Briefly stated, the invention comprises the provision of a temperature sensitive element within a watch which includes a casing, watch movement, mainspring and a bi-directional rotation to unidirectional rotation mechanism where the temperature sensitive element has angular motions with changes in temperature and such movement produces energy to wind the mainspring. More specifically, the invention in one form thereof utilizes a temperature sensitive bimetallic coil, which upon expansion and contraction rotates a driver member, which produces rotation of a shaft in the winding mechanism and effects self winding of the watch. The free or outer end of the coil will angularly deflect with change in temperature. The coil is anchored at the inner end thereof in a coil carrier or a stationary part of the watch and the outer end thereof, upon movement, will drive a driver member with an internal gear. The driver member, in one embodiment of the invention, will in turn drive a plurality of planet gears, which drive a sun gear, mounted to a shaft. The shaft of the sun gear then produces rotation of a cam or eccentric pin which drives the bi-directional to unidirectional conversion mechanism. This arrangement will provide substantially infinite self winding of the watch in a normal environment, even if the watch is not worn for a long period of time, so long as the watch is not stored or otherwise left in a closely temperature controlled environment. In another embodiment of the invention the driver member directly drives I the winding mechanism.

The invention is particularly pointed out and distinctly claimed in the concluding portion of this specification. The invention, however, together with further objects and advantages thereof may be best appreciated by reference to the following detailed description taken in conjunction with the drawings.

BRIEF DESCRIPTION OF THE DRAWINGS

FIG. 2(*a*) is a view, partially in section, showing the manner in which supports are mounted in the watch;

DETAILED DESCRIPTION OF PREFERRED EMBODIMENTS

Figure 1:
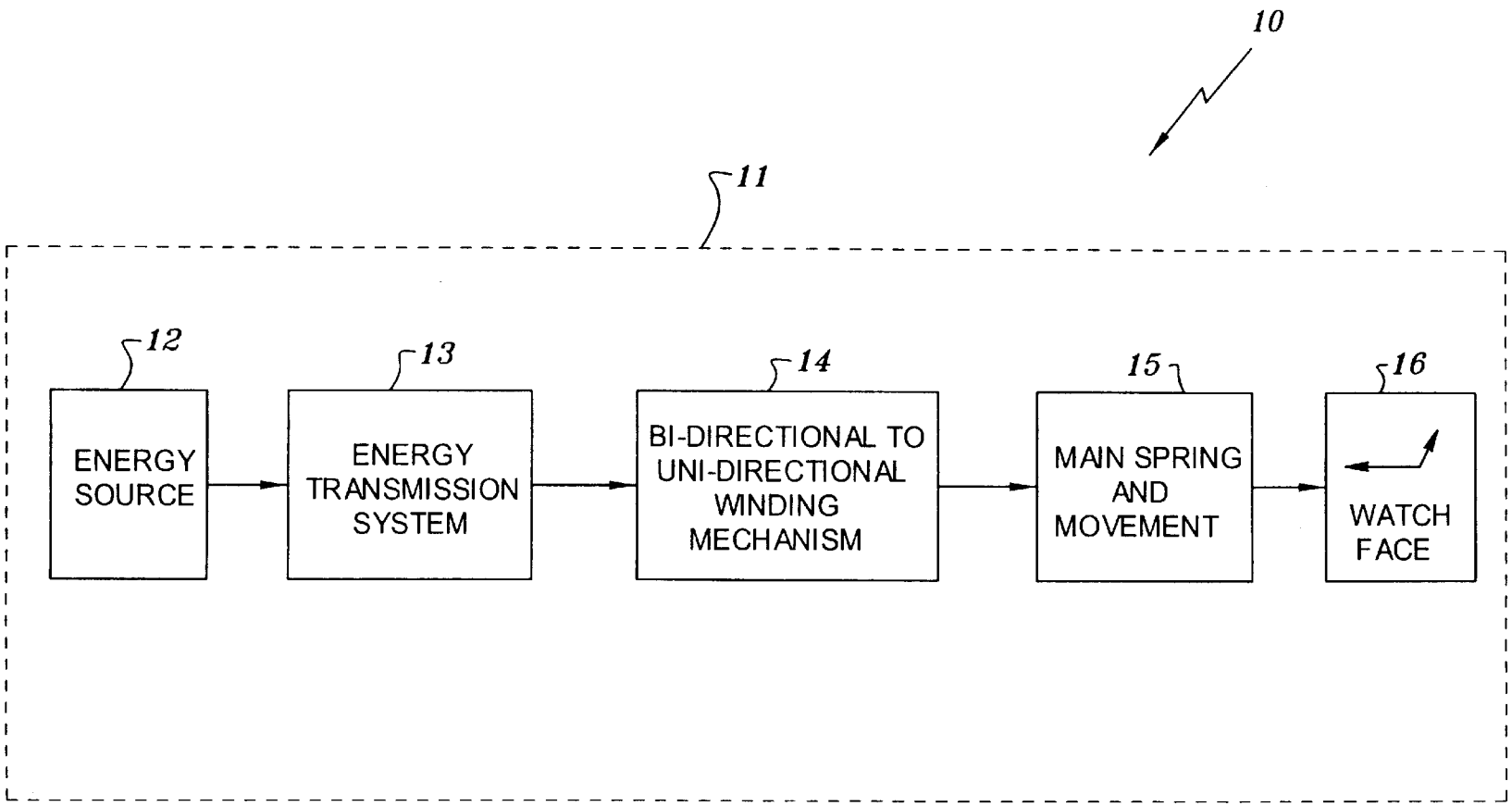
FIG. 1 is a diagram illustrating in functional block form the various operative portions of a wrist watch in which the invention is embodied.

FIG. 1 exemplifies in functional block form the components of a watch in which the invention is embodied. A watch 10 comprises a casing 11, exemplified in broken line. Within the casing 11 is an energy source 12 for operating the watch, an energy transmission system 13, which transmits energy to a bi-directional to unidirectional winding mechanism 14, which may be a Pellaton type or wig-wag mechanism. The unidirectional winding mechanism winds the mainspring, which powers the movement of the watch, both represented by the block identified by the reference numeral 15. Finally, there is the watch face with hands 16 driven by the mainspring through the movement. The functions represented by the reference numerals 14, 15 and 16 are well known in the art and are constructed with varying degrees of quality and complexity which account for the widely varying price ranges of watches.

The present inventions reside in the energy source 12, the energy transmission system 13 and a modified version of winding mechanism represented by the reference numeral 14. Only the structure and function of these portions of a timepiece embodying the invention are described in detail, in as much as the various components of a mechanical timepiece are well known.

Figure 2:
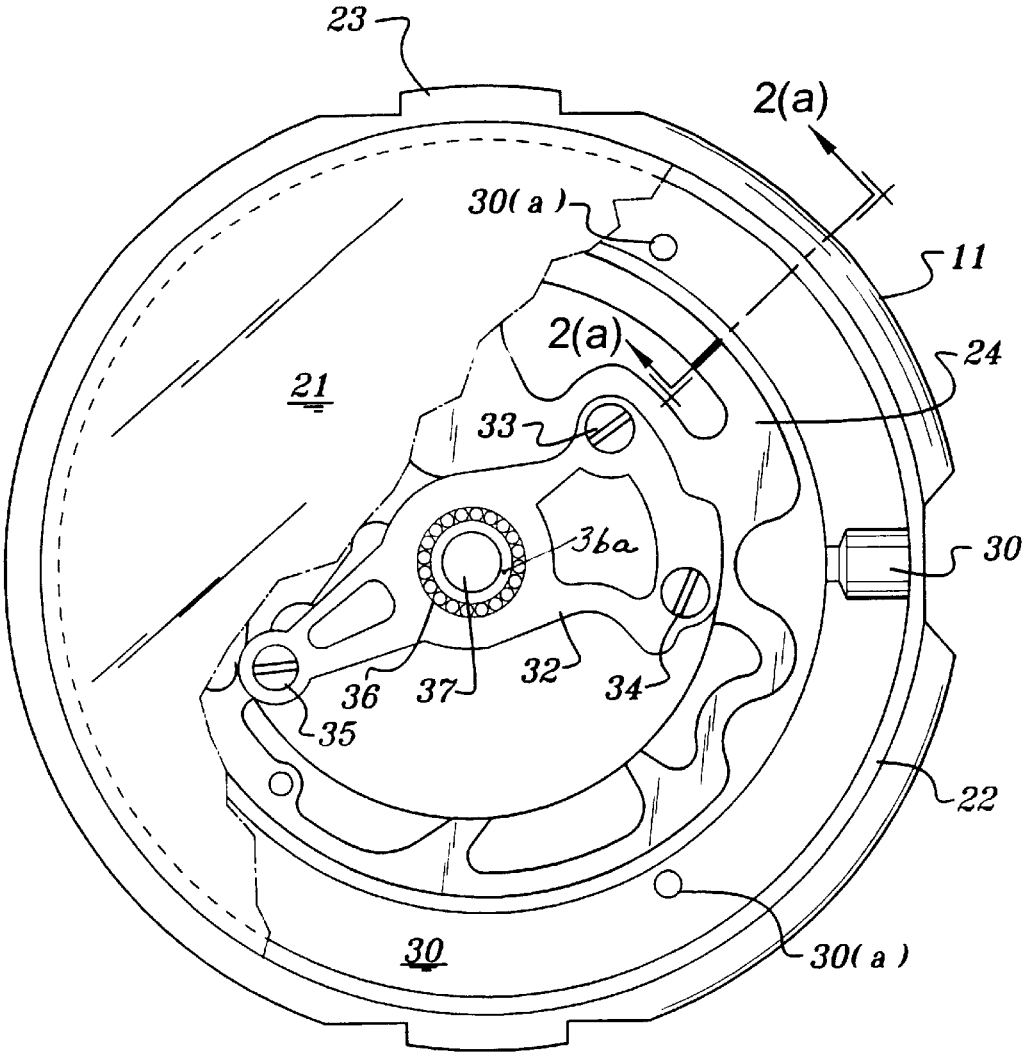
FIG. 2 is a view of a wristwatch with the back cover partially cut away and arranged to receive structure embodying the invention.

Reference is now made to FIGS. 2 and 2(*a*) which exemplify a watch casing 11 with the back cover 21 partially cut away. The back cover 21 may have a friction fit with casing 11 by means of a depending annular flange received in an annular groove 22, or may be screwed to casing 11 FIG. 2 exemplifies a watch casing before inclusion of the present invention and FIG. 2(*a*) illustrates a mounting detail.

Figure 2A:
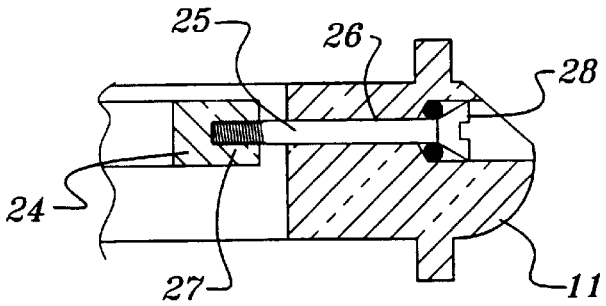

Casing 11 includes lugs 22 for mounting of a wristband. A skeletal support frame 24 is supported in casing 11 as exemplified in FIG. 2*a*. A plurality of screws 25 extend through radial passages 26 in casing 11 and are received in threaded apertures 27 in frame 24. The entrance to passages 26 is enlarged to provide recesses for the heads 28 of mounting screws 25. An elastomeric O-ring 29 is Included beneath the heads of screws 25 to provide shock mounting of frame 21. Casing 11 provides an annular surface or seat 30 for mounting of a bimetallic coil carrier as hereinafter described. The coil carrier is secured in casing 11 on seat 30 by a plurality of screws received in equiangular spaced threaded apertures 30*a*. Also shown is an opening 31 for receiving a winding and setting stem (not shown in FIG. 2).

A bridge member 32 for a supporting a winding mechanism, (on the side opposite that shown in FIG. 2) is secured to support frame 24 by a plurality of screws 33, 34 and 35. Positioned in bridge member 32 is a ball bearing 36 receiving a shaft 37. As hereinafter described, shaft 37 drives a winding mechanism.

Figure 3:
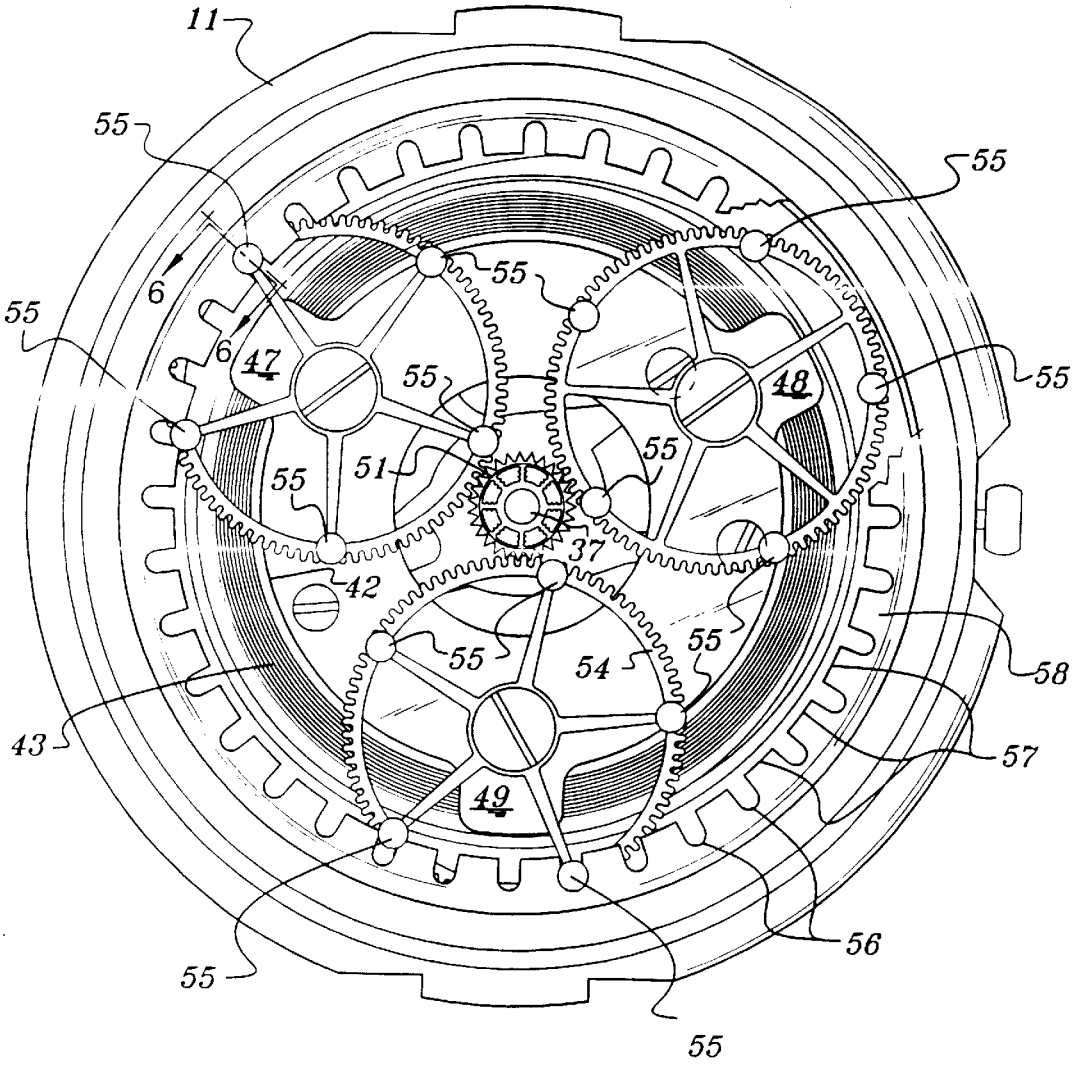
FIG. 3 is a view a wrist watch with the back removed and structure embodying the invention within the watch FIGS. 4(*a*)–4(*d*) are details of a carrier for a bimetallic coil which is received in the watch as shown in FIGS. 2 and 3.
Figure 4B:
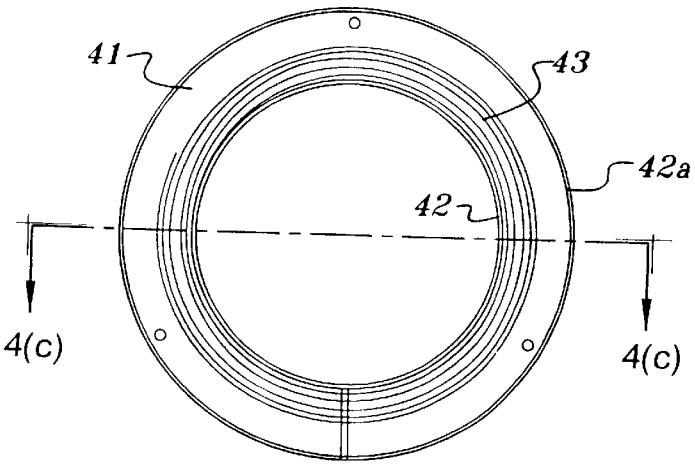
Figure 4A:
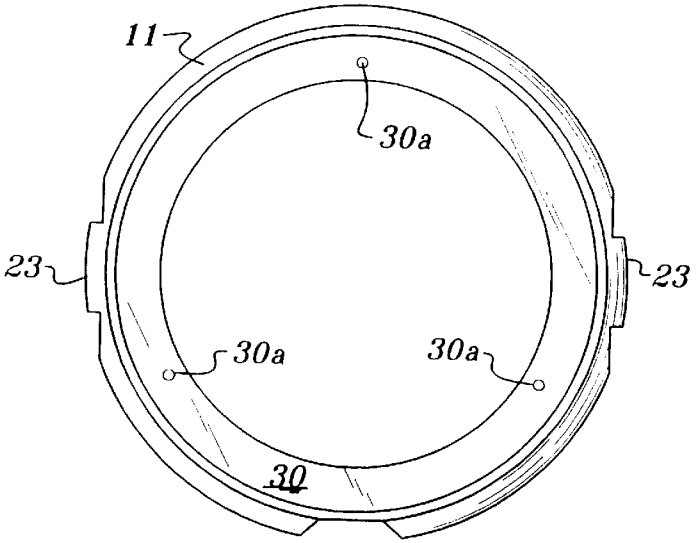
Figure 4D:
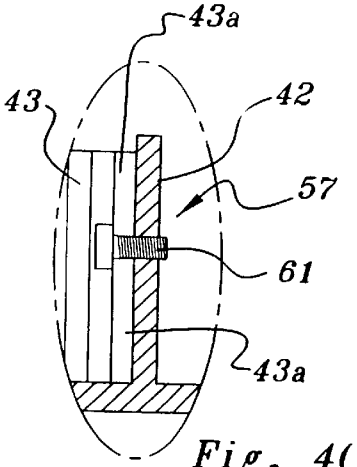
Figure 4C:
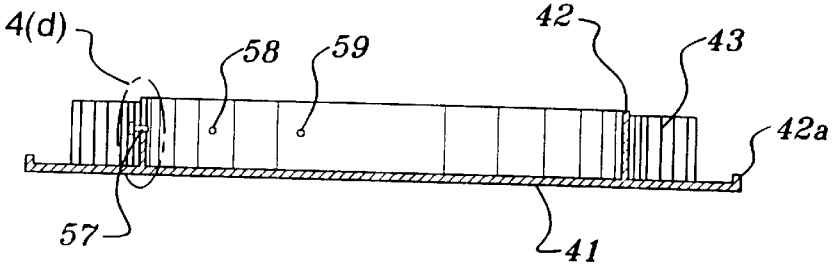

Reference is now made to FIG. 3 taken in conjunction with FIG. 2. FIG. 3 illustrates casing 11 with back cover 21 completely removed. A bimetal coil carrier 41, hereinafter more fully illustrated, is seated on and secured to annular seat 29, FIG. 2. Coil carrier 41 has an inner upstanding annular flange 42 to, which is secured the inner end of a bimetallic coil 43. The outer end of coil 43 is connected to a driver member drivingly rotated by coil 43, as hereinafter pointed out. A mounting plate 44 is secured to bridge member 32 by screws 34 and 35 (FIG. 2) extending through apertures in plate 44. Coil 43 will tend to angularly deflect with change in temperature, but since the inner end is fixed and the outer end is connected to a peripheral flange of a rototatable driver member and restrained from outward radial movement thereby, the outer end will have peripheral movement in both directions dependent upon the direction of change in temperature. While not readily apparent from the drawings, there will be a small spacing between the turns of coil 43 to permit such movement.

Figure 5A:
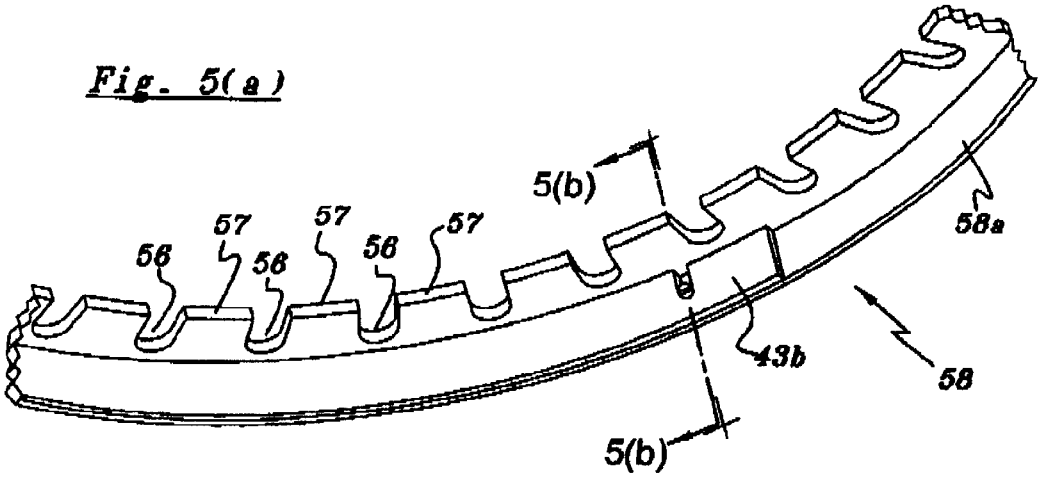
FIGS. 5(*a*)–5(*c*) are details of the connection of the free end of a bimetallic coil to an orbit gear shown in FIG. 3.
Figure 6:
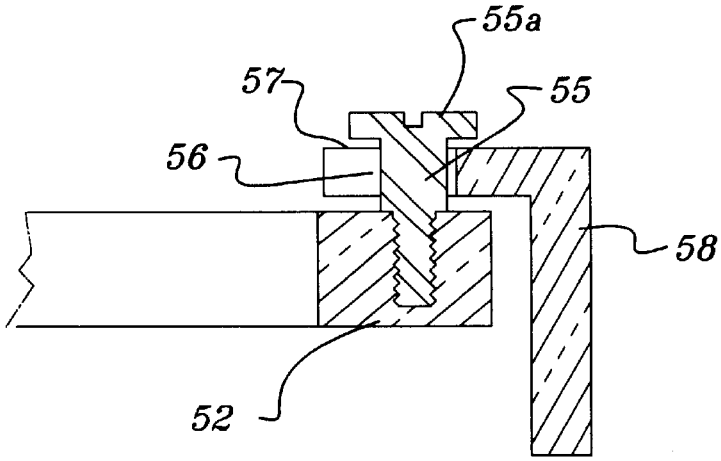
FIG. 6 is a sectional view seen in the plane of lines 6—6 of FIG. 3.

Three equiangular spaced tabs 47, 48, and 49 extend from mounting plate 44 over bimetallic coil 43 and serve to retain coil 43 in coil carrier 41. A sun gear 51 is keyed (key not shown) to shaft 37. Three planet gears 52, 53 and 54 are equi-angularly, rotatably mounted in mounting plate 44 and mesh with and drive sun gear 51 in either direction of rotation. Each of planet gears 52, 53 and 54 have five posts which are received in recesses 56 between teeth 57 of a driver member in the form of an orbit gear 58. Orbit gear 58 is driven by the outer end of coil 43. Orbit gear 58 has a peripheral flange 58*a* (FIG. 5*a*). The posts, hereinafter discussed in more detail in conjunction with FIG. 6, have caps 55*a* thereon, which will overlie the edges of teeth 57 when the posts are in a recess 56. This arrangement retains orbit gear with respect to bimetallic coil 43 and coil carrier 41 and permits orbital as well as rotational motion of orbit gear 58. The teeth 57 of orbit gear have substantially right angle corners defining the entrance into recesses 56 and the recesses have substantially semi-circular bottoms for receiving annular posts, as shown in FIG. 6.

Reference is now made to FIGS. 4(*a*)–4(*d*), which show coil carrier 41 and coil 43 in more detail. FIG. 4(*a*) illustrates casing 11 with seat 30 for coil carrier 41 and screw apertures 30*a* for securing coil carrier 41 thereto. FIG. 4(*b*) is a plan view of coil carrier 41 with a portion of coil 43 thereon and screw apertures 41*a* for securing coil carrier 41 to seat 30. FIG. 41(*c*), which is a section through coil carrier 41 and coil 43 also, illustrates an outer annular flange 42*a* on coil carrier 41. In practice, the outer diameter and free end of coil 43 will extend to outer flange 42*a*. The inner end 43*a* of coil 43 is anchored or secured to flange 42 at three points 57, 58 and 59 as shown in FIG. 4(*c*). An enlarged detail of this anchoring is shown in FIG. 4(*d*). The inner end 43*a* of coil 43 is secured to flange 42 by screws 61.

Figure 5B:
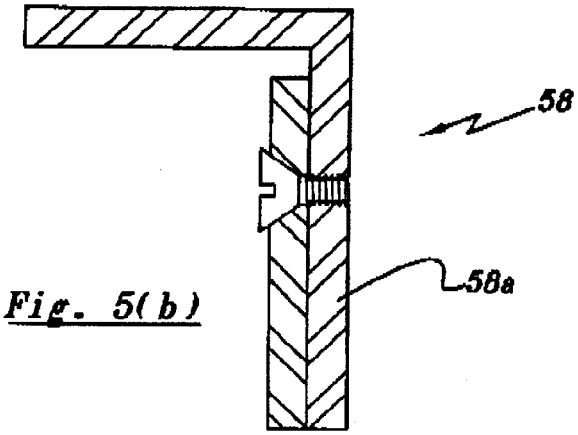
Figure 5C:
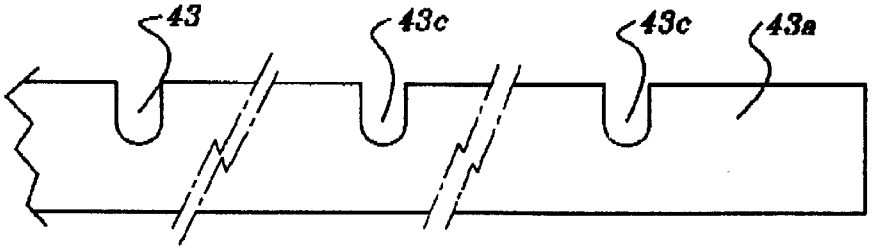

Reference is now made to FIGS. 5(*a*)–5(*c*) to exemplify the connection of the free end 43*b* of coil 43 to orbit gear 58. FIG. 5(*a*) is a perspective view of the free end of coil 43 connected to orbit gear 58. The upper edge of end 43*b* of coil 43 has three notches 43(*c*) defined therein which receive screws therethrough to anchor end 43*b* to the peripheral flange of orbit gear 58 as shown in FIG. 5(*b*).

As hereinafter pointed out in more detail, the coil 43 has an angular deflection of twelve degrees for every Fahrenheit degree change in temperature. This angular deflection is transferred to the orbit gear, which will orbit and rotate in either direction dependent on the direction of change in temperature. Rotation of the orbit gear is imparted to the planet gears, which rotate the sun gear and shaft 37 in either direction dependent on the direction of change in temperature.

Reference is now made to FIG. 6 which is a sectional view in the plane of lines 6—6 of FIG. 3. Posts 55 are provided by the unthreaded shanks of screws. Caps 55*a* overlying the edges of teeth 57 are provided by the screw heads and the posts are screwed in the rims of the planet gears as exemplified by planet gear 52 in FIG. 6. A post 55 is shown in a recess of 56 of orbit gear 58. The caps 55*a* are preferably twice the diameter of posts 55 and overlie the edges of adjacent teeth 57. At least one post 55 of each of planet gears 52, 53, 54 is always in a recess 56. As previously pointed out, the posts 55 with caps 55*a* overlying the edges of adjacent teeth 57 of orbit gear 58 serve to retain orbit gear 58 with respect to bimetallic coil 43 and coil carrier 41. The angular deflection of the free end 43*b* of coil 43 with temperature change will impart orbital motion to gear 58 as well as rotational motion.

Figure 7:
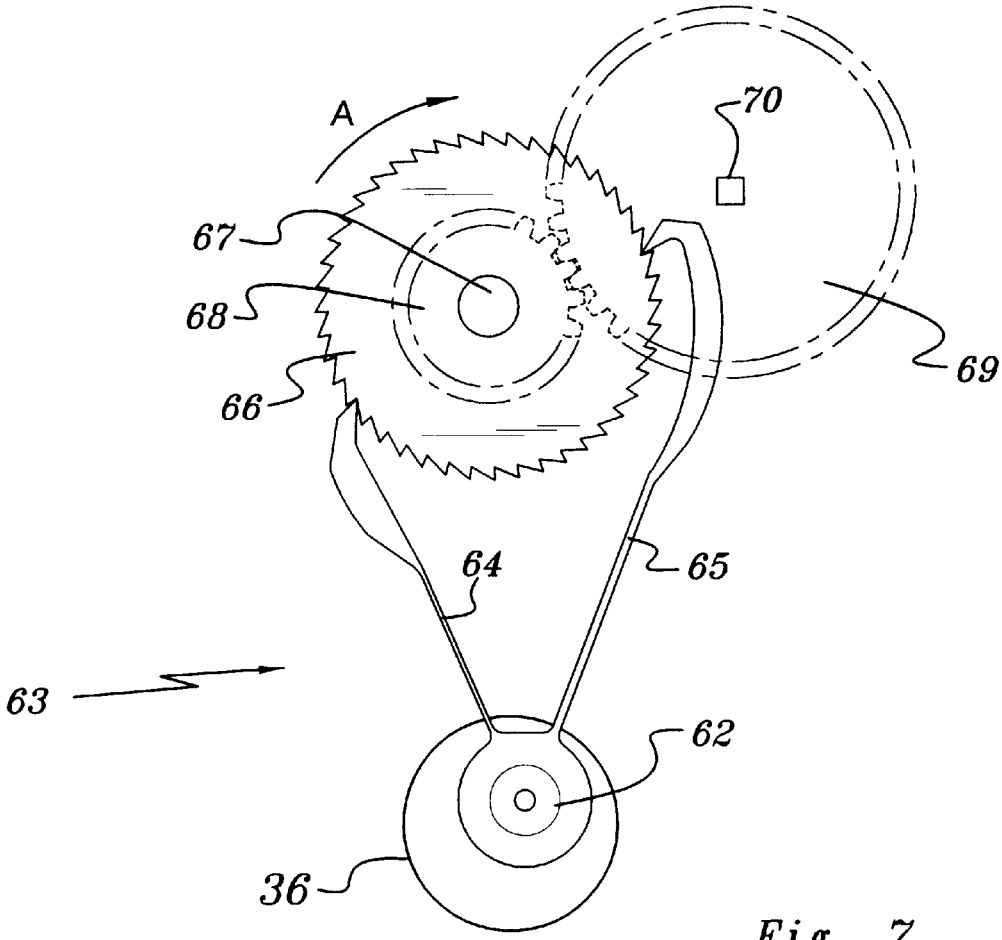
FIG. 7 is a plan view of a bi-directional to unidirectional motion converting mechanism utilized in the invention.

Reference is now made to FIG. 7, which illustrates bi-directional to unidirectional shaft rotation conversion mechanism in the form of a modified Pellaton mechanism. FIG. 7 is a view seen from the opposite side of bridge member 32 as seen in FIG. 2. A Pellaton type arrangement 63 includes a hub 63*a* with pawls 64 and 65 extending therefrom and engaging opposite sides of a ratchet wheel 66 on a shaft 67. A pinion 68 is also on shaft 67. Pinion 68 drives a gear 69 having the arbor 70 of the mainspring (not shown) therein. Rotation of gear 69 by pinion 68 will wind the mainspring. The hub 63*a* of Pellaton type lever 63 is rotatably mounted to a pin 63*b* which is eccentric to the axis of ball bearing 36. A hub 36*a* is received within the inner race of ball bearing 36 to receive shaft 37 (FIG. 2). Eccentric pin 63*b* is mounted to the hub 36*a*.

It will be seen the pawls 64 and 65 will drive ratchet wheel in the direction of arrow A with either direction of pin 63*b*. Simplified, with clockwise rotation of pin 63*b* pawl 65 pulls the teeth of ratchet wheel 66 while pawl 65 slips, and when pin 63*b* rotates counter-clockwise, pawl 64 pushes ratchet wheel 66 in the direction of arrow A, while pawl 65 slips. Both of pawls 64 and 65 have flexibility and will ride over the teeth of ratchet wheel when not acting to rotate ratchet wheel in the direction of arrow A.

Shaft 37 is secured to hub 36*a*. When sun gear 51 is driven the inner race of bearing 36 and hub 36*a* are driven.

Planetary gearing systems may have inherent problems of jamming and require a high quality manufacturing process. The load division between planet gears, the interference of the outer gear, with internal teeth, and the planetary gears and the hazard of jamming are inherent problems to be solved. In the present invention these problems are overcome by having the orbit gear provide a separate track for each planet gear, as hereinafter described.

Orbit gear 58, in the embodiment shown, has thirty-six recesses 56 and teeth 57. Planet gears 52, 53 and 54 each have five posts 55 engaged by orbit gear 58. This ratio makes the planet gears pinions as driven by orbit gear 58. This ratio also provides a separate "track" for each planet gear post. The term "track" refers to the fact that the posts of each orbit gear will enter every third recess 56 of orbit gear 58, and only every third recess. This is further shown by each planet gear having posts at seventy-two angular degree intervals, and the orbit gear having a recess and tooth at ten angular degree-intervals. A post of each planet gear will enter each third recess 56. The orbit gear will rotate thirty angular degrees to provide seventy-two angular rotation degrees of a planet gear. Thus, in the embodiment shown, the orbit gear provides a separate track of twelve recesses 56 and teeth 57 for the posts of each planet gear. It has been found that without the provision of a separate track for the posts of each planet gear that after a short period of operation, the posts will fail to mesh with the orbit gear recesses and binding of the planet gears will occur.

The number of recesses and teeth required for a selected number of planets and planet posts are selected as follows:

$$AB \times C + D \times E = \text{Number of recesses in orbit gear}$$

where

A=First planet gear calculated for given spacing.

B=Number of teeth (posts) on a planet gear to mesh with orbit gear.

C=Whole number of ratio of number of 360° rotations of a planet gear to one 3600° rotation of orbit gear.

D=Number of remaining planet gears.

E=Total number of planet gears.

The back of a watch embodying the invention is selected to be of a good heat conductive material, which will influence the temperature at the coil. Tests utilizing a thermometer strapped to a wrist, as a watch is, have shown the following temperature variations.

When the watch is on the arm for the day, it is subjected to high temperatures due to body heat (on the order of ninety-five degrees). Most watches are worn slightly loose. When the back of the watch is essentially flush on the arm the temperature is up, on the order of ninety degrees F. Due to a slight shift on the arm, the case acts as a heat sink and the temperature drops three to six degrees F. This occurs about every fifteen minutes at room temperatures of seventy-five to seventy eight degrees. In addition there are fluctuations in room temperature due to cycling of the heating or air conditioning thermostats.

The changes in temperature at the watch are more frequent and at a wider range when the watch is worn outside. It was found that the temperature at the watch was ninety degrees plus five degrees and minus ten degrees on a day when the outside ambient temperature was fifty degrees, all temperatures being Fahrenheit.

When the watch is removed at night and subjected only to ambient room temperature it will very quickly drop to ambient room temperature, usually about seventy degrees. During the night the temperature will cycle with fluctuation in room temperature as the thermostatically controlled heat cycles. When the wearer again puts on the watch in the morning, there will be an increase in temperature of the watch casing back up to the external body temperature of the wearer. Change in temperature in either direction will produce self-winding of a watch embodying the invention.

By way of example only, the specifications of a bimetallic coil used in the invention will be set forth. A coil used in the practice of the invention in a prototype watch was a strip of 36-10 thermostatic bimetal strip of 0.008" thickness and 0.078" wide. The length was forty-eight to fifty-two inches, the inside diameter was 0.850" and the outside diameter 1.23". This material was obtained from Hood & Co., Inc. of Hamburg, Pa., through a wholesale distributor. This coil had a deflection of twelve angular degrees with a change in temperature of one degree F.

The movement of the free end of the coil in inches/degree temperature change is as follows:

$$d_o \times 3.14/360° \times 12°/° \text{ F.}$$

where $d_o$=outside diameter pi=3.14

Thus, for a one degree F. temperature change the free end of the coil will move 0.1287 inches. Considering a change of temperature of four degrees F. every fifteen minutes over a fifteen-hour period, the free end of the coil will move 7.722 inches. This is more than sufficient to replace the power consumed by the watch movement from the mainspring. Even if the watch is not worn, the normal temperature cycling in a normal heated or air conditioned environment will provide infinite self-winding. If a watch embodying the invention should be left in an absolute temperature controlled environment, the watch would have autonomy of thirty-six hours.

The following analysis and calculations for a prototype wristwatch is set forth below with energy sometimes expressed in terms of circumferential movement of the mainspring and the bimetallic coil.

The gear ratios are:

| | |
|---|---|
| Orbital gear to planet gear | 36:15 = 2.40:1 |
| Planet gear to sun gear | 80:22 = 3.64:1 |
| Orbit Gear to Sun Gear | = 8.74:1 |
| Pellaton Mechanism | 1:10 360° of total rotation of shaft 37 causes 36° of unidirectional rotation of ratchet wheel |
| Pinion 66 to winding | 10:42 |

Thus one revolution of the winding wheel or gear 69 requires an equivalent of forty-two rotations of sun gear 51 or 360°×42 total degrees of rotation (clockwise and counter-clockwise)

The ratio of the two gear trains is $$42/8.74=4.883$$

The mainspring of the watch had a barrel diameter of 0.372". The energy release of the mainspring is 60°/hour. Thus $$0.372 \times 3.14/360° = 0.003245" \text{ for one angular degree of motion}$$

The energy release of the mainspring per hour is 0.194676"/angular degree/hour or 4.672" per day to drive the watch movement.

As previously set forth the movement of the free end 43*a* of bimetallic coil moves 0.1287" with a one degree F. change in temperature. The free end of bimetallic coil 43 will move (plus and minus) 2.059 in an hour considering four, four-degree temperature changes every hour.

The ratio of movement of the bimetallic coil to the mainspring/hour is $$2.059/0.1947=10.588$$

The loss in the gear ratios is 4.883. Therefore the ratio of energy storage in the mainspring of the watch to energy consumed by the movement of the watch which may be termed the power restoration ratio is $$10.588/4.883=2.162$$

For unseen mechanical discrepancies surfacing in a system from wear and abuse, and assuming that only fifty percent (50%) of the foregoing power restoration is available, the power restoration ratio will still be greater than unity. The foregoing power restoration ratio was calculated using a fifteen-hour period. Following is a breakdown of a twenty-four hour cycling period.

1. Wearing of the watch is commenced at 7:00 AM in a seventy-degree environment. By 7:15 AM the temperature at coil will increase by twenty-five degrees (25° F.).
2. By 8:00 AM there will be three more temperature changes of four degrees (120° F.).
3. From 8:00 AM to 11:00 PM there will be sixty temperature changes of four degrees (240° F.).
4. Removing the watch at 11:00 PM, there will a twenty-five degree drop.

This totals three hundred and two (302) degrees of temperature change. The circumferential movement of the orbit gear 58 will total

302°×0.1287"/° F.=38.857"

The energy release by the mainspring in twenty-four hours is 4.672" times the gear ratio loss of 4.883 or 22.811. But considering the dormant hours of 11:15 PM to 7:00 AM at half of the day time rate of four degrees F. per hour, there will be a total of fifty-five degree F. changes (55° F.). This will produce an additional 7.080" of movement of the bimetallic coil 58 and the power restoration period over this twenty-four hour period is still greater than two.

Figure 8:
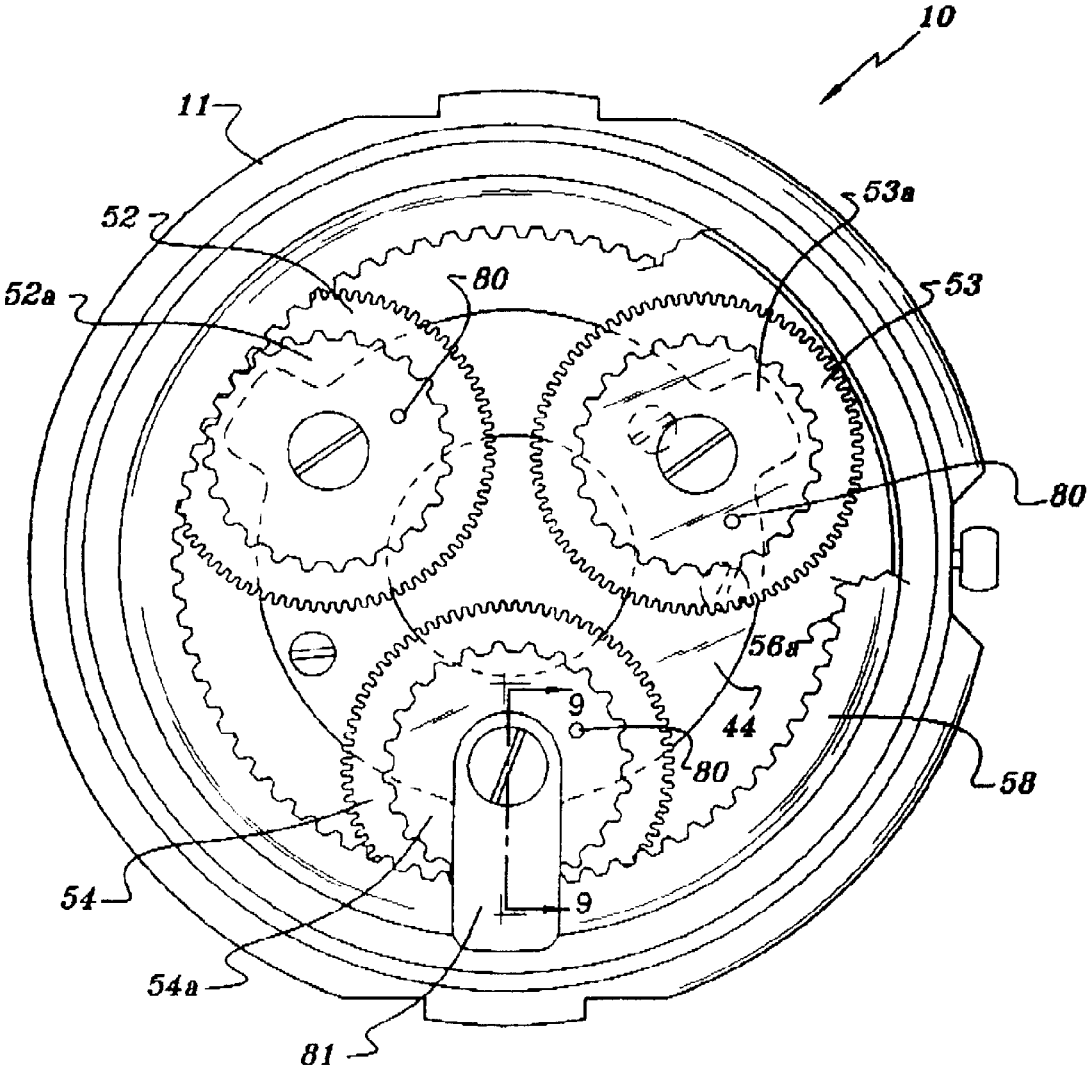
FIG. 8 is a view similar to FIG. 3 illustrating a further embodiment of the invention.
Figure 9:
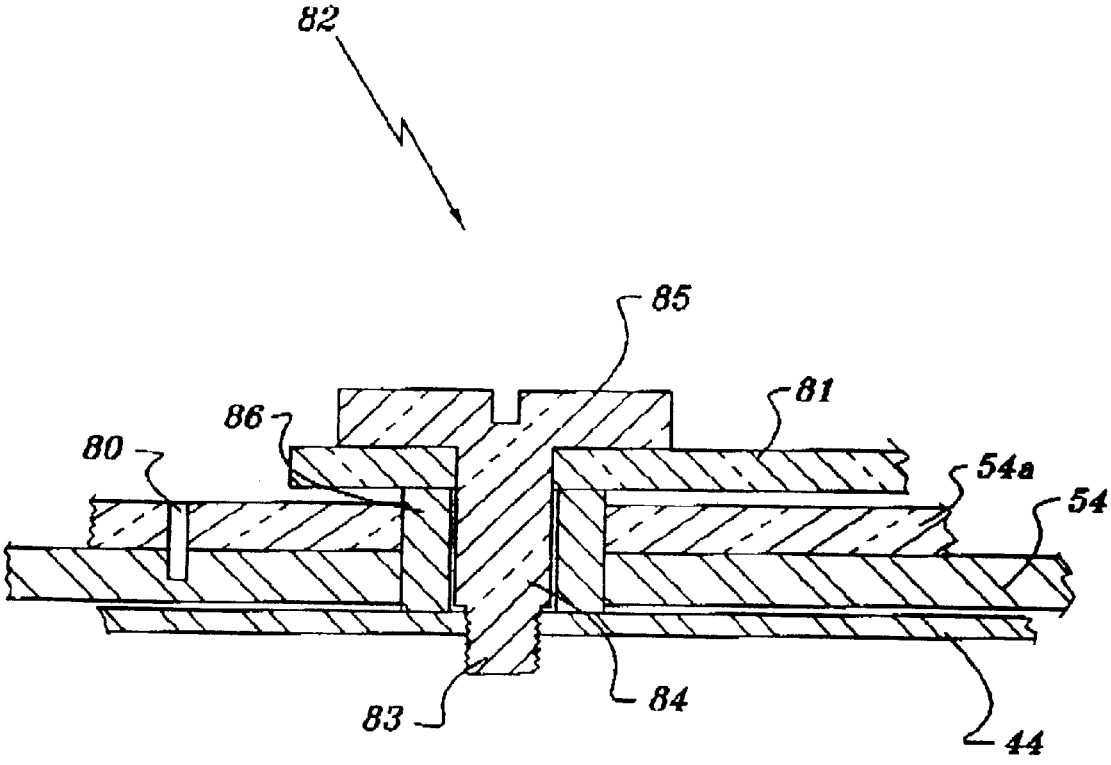
FIG. 9 is a sectional view seen in the plane of lines 9—9 of FIG. 8.

A further embodiment of the invention is shown in FIGS. 8 and 9. In FIG. 8 like reference numerals to those previously used in conjunction with the description in FIGS. 1–3 are used for similar parts.

FIG. 8 illustrates casing 11 with back cover 21 completely removed. Bimetallic coil 43 is not shown in FIG. 8 for simplicity of illustration. A mounting plate 44 is secured to bridge member 32 by screws 34 and 35 (FIG. 2) extending through apertures in plate 44 as shown in FIG. 3.

The three planet gears 52, 53 and 54 are equi-angularly, rotatably mounted in mounting plate 44 and mesh with and drive sun gear 51 (FIG. 3) in either direction of rotation. The gears 52, 53, and 54 are shown in different form in FIG. 8, as is orbiter 58. Each of planet gears 52, 53 and 54 has another gear pinned thereto 52*a*, 53*a* and 54*a*, respectively, which rotate therewith, as exemplified by pin or screws 80.

A retaining finger 81 overlies and retains orbit gear 58 as hereafter described in conjunction with FIG. 9. This arrangement retains orbit gear with respect to bimetallic coil 43 and coil carrier 41 and permits orbital as well as rotational motion of orbit gear 58.

The operation of the embodiment of FIG. 8 is the same as that of FIG. 3. The gears 52*a*, 53*a* and 54*a* have replaced the posts 55 of the embodiment of FIG. 3. Instead of notches, the orbit gear has teeth 56*a* defined thereon which mesh with the teeth of gears 52*a*, 53*a* and 54*a*. The gears 52*a*, 53*a* and 54*a* may be considered pinions but in view of the number of teeth thereon are referred to as gears.

The mounting of the gears also provides for adjustment of the depth of mesh of the teeth of gears 52*a*, 53*a* and 54*a* with the teeth of orbit gear 55. Each pair of gears 52, 52*a*; 53, 53*a*; and 54, 54*a* is rotatable essentially about the axis of a retaining member 82. Each retaining member 82 comprises a screw member having threads 83 secured in mounting member 44, a shank 84 and a head 85 overlying retaining finger 81 and a bushing 86 disposed about shank 84. Gears 54 and 54 a rotate about the axis of bushing 86. Bushing 86 is slightly larger in inside diameter than shank 84. Bushing 86 is held in compression under the head 85 of member 82 when it is tightened down. This permits adjustment of the position of the axis of bushing 86 and hence the axis of gears 54 and 54*a*. This arrangement enables the positioning of the planetary gears such that they always make contact with the orbit gear at the pitch diameter of the gear teeth. This also limits the orbital movement of orbit gear, which provides a smoother operation of the planetary gear system. The same planet gear axis adjustment may be used for the planet gears of FIG. 3.

In one embodiment, as shown in FIGS. 8 and 9, the gears have the following relationship:

| | |
|---|---|
| Orbit gear 58 | 72 teeth |
| Upper planet gear 54a | 24 teeth |
| Lower planet gear 54 | 80 teeth |
| Sun gear 57 not shown in Figure 8 | 44 teeth |

This provided a drive ratio of 4.8:1, planet to sun gear. The operation of the mechanism of FIGS. 8 and 9 is much smoother than the mechanism previous described due to the larger number of teeth.

It is to be noted that the ratio of the teeth of orbit gear 58 to the teeth of the upper planet gears 54*a* again provides a separate track for the teeth of each of the upper planet gears.

Figure 10:
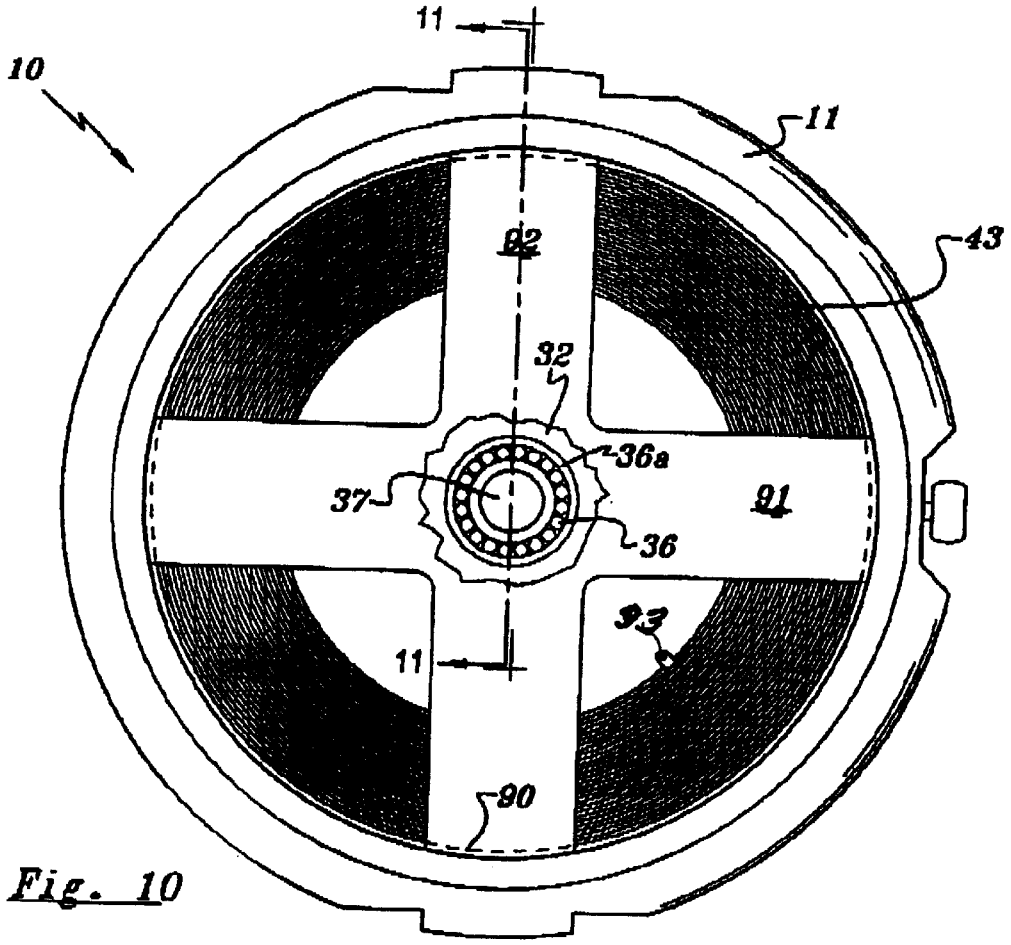
FIG. 10 is a view of a watch with the back removed illustrating another embodiment of the invention.
Figure 11:
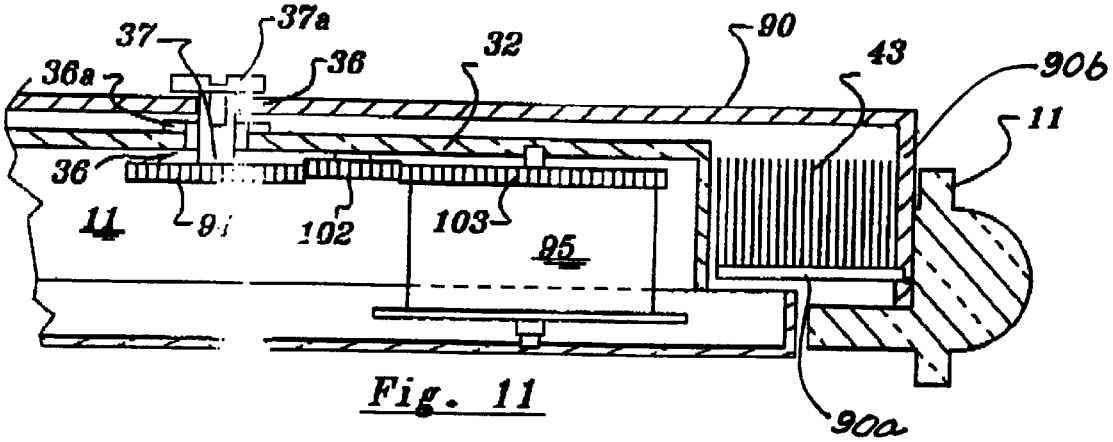
FIG. 11 is an enlarged sectional view seen in the plane of lines 11—11 of FIG. 10.

Reference is now made to FIGS. 10 and 11. FIG. 10 is a view of a watch embodying the invention with the back removed. The bimetallic coil 43 is disposed within a carrier and drive member 90 having cross arms 91 and 92. Arms 91 and 92 are broken away at their center to show bearing member 36 and shaft 37 therebelow in bridge member 32. Bridge member 32 is not entirely shown in FIG. 10, for clarity of illustration. The outer race of bearing 36 is supported on bridge member 32. As coil 43 expands and contracts with temperature it will rotate member 90 and produce rotation of shaft 37 in either direction. Member 90 is fast on shaft 37 and retained thereon by a screw 37*a* extending into shaft 37. Member 90 receives a snap-in cover ring 90*a* into peripheral flange to aid in retaining coil 43. This allows the provision of a self-contained energy source for the watch. Member 90 with cover ring 90a and coil 43 may be separately assembled, placed in the watch casing on shaft 37 and retaining screw 37*a* is inserted into shaft 37.

The inner end of coil 43 is secured to bridge member 32, as shown in FIG. 2, by a clip 93. The outer end of coil 43 has previously been secured to member 90, as previously described in conjunction with orbit gear 58 as shown in FIG. 5(*a*) or any other suitable mariner.

This allows the provision of a self-contained, cartridge-type energy source for the watch. Member 90 with cover ring 90*a* and coil 43 may be separately assembled, placed in the watch casing, shaft 37 is inserted into bearing 36 in bridge member 32 and then clip 93 is secured to bridge member 32

In FIG. 11, shaft 37 is shown as driving a pinion gear 94 of a bi-directional winding mechanism, which will drive the barrel 95 of the mainspring as hereinafter described. The movement of the watch is located in the area identified by the reference M.

Figure 12:
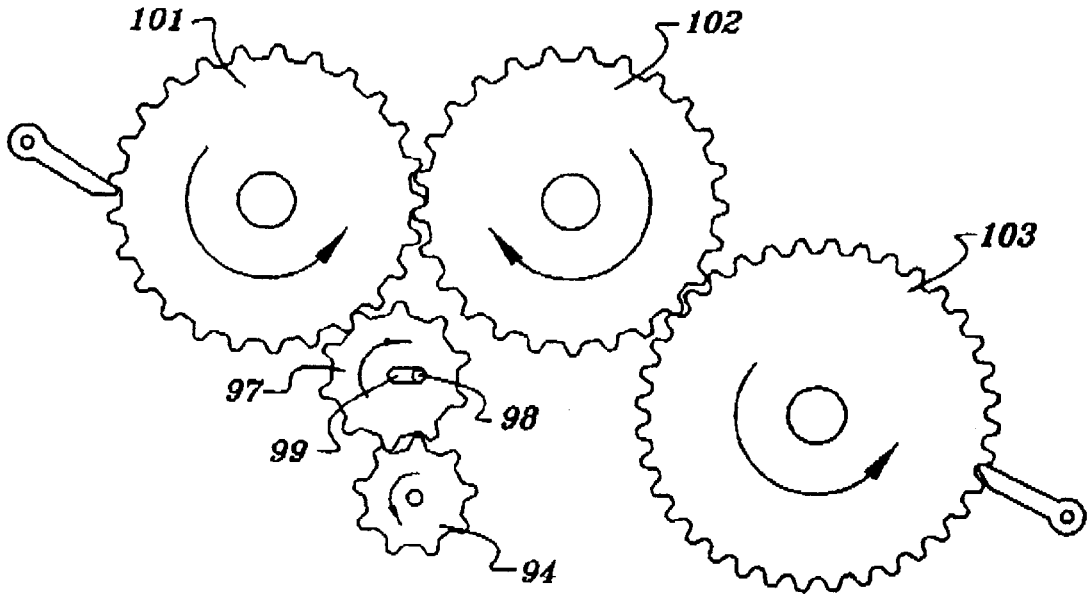
FIG. 12 is a plan view of another bi-directional motion converting mechanism.

Another bi-directional to unidirectional winding mechanism is shown (not to scale) in FIG. 12 as it may be seen from the underside of FIG. 11. Pinion 94 on shaft 37 engages what is termed a "wig-wag" gear 97. Gear 97 is on a shaft 98, which is moveable in a slot 99 to drive either of gears 101 or 102 rotatable on shafts in bridge member 32 (not shown in FIG. 12). Gear 97 will move longitudinally in slot 98 and rotate in a direction dependent on the direction of rotation of pinion 94. When pinion 94 rotates in the direction of the arrow shown, it will drive wig-wag gear 97 to the position shown in slot 99, which in turn drives gear 101 as shown. This results in rotation of gears 102 and 103 as shown. If gear 94 is rotated in the opposite direction shaft 98 will moved to the other end of slot 99 and wig-wag gear 97 will be in engagement with gear 102. Gear 102 will rotate in the same direction and thus gear 103 will always rotate in one direction. This produces unidirectional winding of the mainspring barrel for either direction of rotation of pinion 94. The entire mechanism shown in FIG. 12 is termed a "wig-wag" mechanism.

In the embodiment of FIGS. 10–12, pinion 94 will have the same total angular rotation as member 90, since both are fast on shaft 37.

| | |
|---|---|
| pinion 94 | 18 teeth |
| wig-wag gear 97 | 14 teeth |
| gears 101, 102 and 103 | 32 teeth |

This provides a gear ratio of 0.5625 from pinion 94 to mainspring barrel gear 103.

Consider the previous example of a twenty-four hour cycle where:

| | |
|---|---|
| Coil deflection | = 12°/° F. |
| Total degree F changes in twenty-four hours | = 357 |
| Total Equivalent Angular deflection of coil 43 in 24 hours | = 4284° |
| Total Equivalent revolutions = rev. of member 90 in 24 hours | = 11.9 rev. |
| Number of equivalent revolutions of pinion 94 | = 11.9 |
| Input Revolutions of mainspring barrel 95 is 11.9 × 18/14 × 14/32 | = 6.694 rev./day |
| Power consumption of mainspring is 60°/hour | = 4 rev./day |
| Power Input to Mainspring/Power Consumption | = 1.676 |

While the input to consumption ratio is greater than unity, the mainspring will never be over wound. As the mainspring is wound, its resistance to further winding will increase and reach a point that the coil 43 cannot overcome. At this point, the power out put torque from coil 43 will equal the resistance torque of the mainspring and a constant power input to the mainspring to drive the watch movement is established. This is sometimes referred to as the Remontaire effect. If the coil 43 cannot overcome the resistance of the mainspring, the coil will deflect angularly.

A unity power input to power consumption ratio would be reached if there were only enough degree F. temperature changes to provide angular movement of coil 43 equal to the power consumption from the main spring.

Returning to the previous example, assume that the watch was not removed at night. This would eliminate the two twenty-five degree temperature changes when the watch is removed in the evening and put back on in the morning. Then, the total temperature change in a twenty-four hour period is 302 F.

This will give a total angular deflection of coil 43 of 3624 degrees or 10.06 equivalent revolutions of member 90 and pinion 94. This will result in a power input to the mainspring barrel 95 of 5.69 revolutions which is 1.69 revolutions greater than the daily power consumption of the mainspring. This is more than sufficient to overcome any mechanical losses in the system.

The term "bi-directional to unidirectional" has been used herein for purposes of describing two mechanisms, which convert bi-directional motion of a first shaft to unidirectional motion of another shaft. The term bi-directional to unidirectional also includes mechanisms in which there is only one direction of rotation of a shaft to unidirectional motion of another shaft. For example, in the mechanism of FIG. 12, gear 101 may be eliminated and gear 103 would be driven only during counter clockwise rotation of gear 94. Wig-wag gear 97 would engage gear 102 only upon counter clockwise rotation of gear 94.

Other bi-directional drive mechanisms, if suitable, may be utilized. Also, the wig-wag winding mechanism of FIG. 12 may be used in a timepiece which utilizes a planetary gearing energy transmission as disclosed in conjunction with FIG. 3.

The direct drive embodiment of FIGS. 10 and 11 reduces the number of parts in relation to the previously described embodiments. It is especially advantageous in eliminating the planetary gearing system and any attendant problems therewith. The direct drive arrangement also makes it easier for up and down scaling in watch size and for the use of a wider variety of watch movements. The reduction of parts also reduces manufacturing costs from the standpoint of both parts and labor. The coil is also more susceptible to change in temperature due to convection.

The invention, while being described in relation to a wristwatch is also applicable to clocks, which are used in an environment where the temperature is controlled by normal thermostats.

It may thus be seen that the objects of the invention set forth above as well as those made apparent are efficiently attained. While preferred embodiments of the invention have been set forth for purposes of disclosure, modifications to the disclosed embodiments as well as other embodiments thereof may occur to those skilled in the art. Accordingly, the appended claims are intended to cover all modifications to the disclosed embodiments of the invention as well as other embodiments thereof, which do not depart from the spirit and scope of the invention.

What is claimed is:

1. A self winding timepiece which includes a casing, a movement, a main spring for driving said movement and a winding mechanism for said main spring in said casing, an energy source for driving said winding mechanism which comprises an element subject to angular deflection in response to changes in temperature and means coupled to said element for converting angular deflection of said element to motion for driving said winding mechanism.

2. The timepiece of claim 1 wherein said element is a bimetallic coil having a secured inner end and a moveable outer end.

3. The timepiece of claim 2 wherein said means coupled includes a driver member coupled to the outer end of said coil and rotatable upon movement of said coil, the inner end of said bimetallic coil being secured in said casing, said driver member being coupled to said winding mechanism.

4. The timepiece of claim 3 wherein said driver member has a peripheral flange which restrains said coil from outward radial movement.

5. The timepiece of claim 3 wherein said driver member further includes a lower ring member enclosing one side of said bimetallic coil.

6. The time piece of claim 3 wherein said driver member is an orbit gear coupled to the free end of said coil and rotatable in either direction with movement of said bimetallic coil, a plurality of equi-angularly spaced planet gears engaged by said orbit gear and driven thereby, a sun gear having a shaft and engaged by said planet gears, said shaft of said sun gear driving said winding mechanism.

7. The time piece of claim 6 wherein said planet gears each include an upper gear engaging said orbit gear and a lower gear engaging said sun gear, said upper and lower gears of each pair being in fixed relation to each other.

8. The time piece of claim 7 wherein the axes of said planet gears are adjustable to vary the depth of engagement of the teeth of said planet gears with said orbit gear.

9. The time piece of claim 6 wherein the axes of said planet gears are adjustable to vary the depth of engagement of the teeth of said planet gears with said orbit gear.

10. The timepiece of claim 6 further including a bridge member supported in said casing supporting said winding mechanism, a mounting member for said planet gears and said sun gear, said mounting member being mounted to said bridge member.

11. The timepiece of claim 9 where said mounting member has outwardly extending tabs at least partially overlying said bimetallic coil in said carrier.

12. The timepiece of claim 1 which is a wrist watch.

13. The time piece of claim 1 which is a wrist watch having a metallic back cover arranged to contact the skin of a wearer and said bimetallic coil is influenced by the temperature of said back cover.

14. The apparatus of claim 6 wherein the number of teeth of said orbit gear defines a separate track for the teeth of each planet gear engaged by the orbital gear.

15. The apparatus of claim 7 wherein the number of teeth of said orbit gear defines a separate track for the teeth of each planet gear engaged by the orbital gear.

16. The apparatus of claim 1 where said winding mechanism is a bi-directional to unidirectional converting mechanism comprising a member having a hub and two extending pawls, a ratchet wheel on a shaft operated by said pawls to produce unidirectional rotational motion of said shaft and means eccentric to the axis of said sun gear connecting said sun gear to said hub.

17. A self winding timepiece which includes a casing, a main spring, a movement and a bi-directional to unidirectional winding mechanism for said main spring in said casing, an energy source for driving said winding mechanism which comprises a bimetallic coil having a moveable free outer end and subject to angular deflection in response to changes in temperature and means coupled to said free outer end of said coil for converting angular deflection of said coil to rotary motion for driving said winding mechanism.

18. The timepiece of claim 17 further including a rotatable driver member, the inner end of said coil being anchored in said watch, said free outer end of said coil being secured to said rotatable member whereby upon deflection of said coil due to change in temperature said outer end of said coil rotates said rotatable member.

19. The timepiece of claim 18 wherein said rotatable driver member is coupled to a shaft and said shaft drives said winding mechanism.

20. The timepiece of claim 18 wherein said rotatable driver member is an orbit gear having internal teeth, a plurality of angularly spaced planet gears having teeth meshing with the internal teeth of said orbit gear, a sun gear on a shaft and having teeth meshing with the teeth of said planet gears, said shaft of said sun gear driving said winding mechanism.

21.The timepiece of claim 20 further including a bridge member supported in said casing and supporting said, a mounting member for said planet gears and said sun gear, said mounting member being mounted to said bridge member.

22. The timepiece of claim 20 further including a bridge member in said casing, said bridge member supporting said winding mechanism, a bearing member in said bridge member having a shaft therein, said shaft being driven by said rotatable driver member from one side of said bridge member, said shaft extending through said bridge member and driving said winding mechanism.

23. The timepiece of claim 17 further including an annular driver member within said casing and receiving said coil therein, the outer free end of said coil coupled to said annular member whereby said annular member is rotated by said coil upon change in temperature and means coupling said annular member to said winding mechanism.

24. The timepiece of claim 20 further including a carrier member for said coil, said mounting member having outwardly extending tabs at least partially overlying said bimetallic coil in said carrier.

25. The timepiece of claim 21 where said mounting member has outwardly extending tabs at least partially overlying said bimetallic coil in said carrier.

26. The timepiece of claim 17 which is a wrist watch.

27. The time piece of claim 17 which is a wrist watch having a metallic back cover arranged to contact the skin of a wearer and said bimetallic coil is influenced by the temperature of said back cover.

28. The timepiece of claim 20 wherein the number of teeth of said orbit gear defines a separate track for the teeth of each planet gear engaged by the orbital gear.

29. The timepiece of claim 21 where said bi-directional to unidirectional converting mechanism comprises a member having a hub and two extending pawls, a ratchet wheel on a shaft operated by said pawls to produce unidirectional rotational motion of said shaft and means eccentric to the axis of said sun gear connecting said sun gear to said hub.

30. A self winding timepiece comprising a casing, a movement, a mainspring for operating said movement, a winding mechanism for said mainspring, an energy source for operating said winding mechanism to wind said mainspring, said energy source comprising a bimetallic coil having inner and outer ends and being subject to angular deflection with change in temperature, a rotatable driver member having a peripheral flange in said casing, said coil being disposed in said driver member and having its outer end attached to said flange, said inner end of said coil being secured within said casing, and means connecting said driver member to said winding mechanism.

31. The timepiece of claim 30 wherein said winding mechanism is driven by a shaft and said rotatable driver member is coupled to said shaft.

32. The timepiece of claim 30 wherein said winding mechanism is driven by a shaft and said rotatable driver member is an orbit gear driving a sun gear on said shaft and said means connecting said driver to said winding mechanism includes a plurality of planet gears driven by said orbit gear and meshing with said sun gear.

33. The timepiece of claim 32 wherein the number of teeth of said orbit gear defines a separate track for the teeth of each planet gear engaged by said orbit gear.

34. A mechanism responsive to changes in temperature for producing unidirectional rotary motion of a shaft comprising an element subject to angular deflection in responsive to changes in temperature, an orbit gear having internal teeth coupled to one end of said element subject to angular deflection and arranged to be rotated in either direction by the angular deflection of said element, a plurality of equi-angular spaced planet gears engaged by said internal teeth and driven by said orbital gear, a sun gear having a shaft engaged by said planet gears and arranged to be driven by said planet gears and a bi-directional to unidirectional mechanism driven by said sun gear shaft for converting movement of said sun gear shaft to unidirectional rotation.

35. The apparatus of claim 34 wherein the number of teeth of said orbit gear defines a separate track for the teeth of each planet gear engaged by the orbital gear.

36. The apparatus of claim 34 where said bi-directional to unidirectional converting mechanism comprises a member having a hub and two extending pawls, a ratchet wheel on a shaft operated by said pawls to produce unidirectional rotational motion of said shaft and means eccentric to the axis of said sun gear connecting said sun gear to said hub.

37. In a self winding timepiece which includes a housing, a movement, a mainspring for driving said movement and a winding mechanism for winding said mainspring and a mechanism for driving said winding mechanism in said housing; the improvement comprising, said mechanism for driving and winding mechanism comprising an element subject to angular deflection in response to changes in temperature and means coupled to said element for converting angular deflection of said element to motion for driving said winding mechanism.

38. The improvement of claim 37 wherein said element is a bimetallic coil having a secure inner end and a moveable outer end.

39. The improvement of claim 38 wherein said means coupled to said element includes a rotatable driver member coupled to the outer end of said coil and rotatable upon movement of said coil, the inner end of said bimetallic coil being secured in said housing, said driver member being coupled to said winding mechanism.

40. The improvement of claim 39 wherein said driver member has a peripheral flange which restrains said coil from outward radial movement.

41. The improvement of claim 39 wherein said driver member further includes a lower ring member enclosing one side of said bimetallic coil.

42. The improvement of claim 39 wherein said driver member is an orbit gear coupled to the free end of said coil and rotatable in either direction with movement of said coil, a plurality of equi-angularly spaced planet gears engaged by said orbit gear and driven thereby, a sun gear having a shaft and engaged by said planet gears, said shaft of said sun gear driving said winding mechanism.

43. The improvement of claim 42 wherein said planet gears each include an upper gear engaging said orbit gear and a lower gear engaging said sun gear, said upper and lower gears of each pair being in fixed relation to each other.

44. The improvement of claim 42 wherein the axes of said planet gears are adjustable to vary the depth of engagement of the teeth of said planet gears with said orbit gear.

45. The improvement of claim 42 further including a bridge member supported in said housing supporting said winding mechanism, a mounting member for said planet gears and said gear, said mounting member being mounted to said bridge member

46. The improvement of claim 45 wherein said mounting member has outwardly extending tabs at least partially overlying said bimetallic coil in said carrier.

47. The improvement of claim 42 wherein the number of teeth of said orbit gear defines a separate track of the teeth of each planet gear engaged by the orbit gear.

48. The improvement of claim 43 wherein the number of teeth of said orbit gear defines a separate track for the teeth of each planet gear engaged by the orbit gear.

* * * * *

UNITED STATES PATENT AND TRADEMARK OFFICE

CERTIFICATE OF CORRECTION

PATENT NO. : 6,457,856 B1 
DATED : October 1, 2002
INVENTOR(S) : Steven Phillips It is certified that error appears in the above-identified patent and that said Letters Patent is hereby corrected as shown below:

Column12,
Line 66, “time piece” should be -- timepiece --.
Line 67, delete “free” and -- outer -- should be inserted.

Column 13,
Lines 6, 10, 13 and 26, “time piece” should be -- timepiece --.
Lines 30, 34 and 37, “apparatus” should be -- timepiece --.
Line 58, “watch” should be deleted and -- casing -- should be inserted.
Lines 59 and 61, after “rotatable”, -- driver -- should be inserted.

Column 14,
Lines 21 and 23, (two occurences) after “annular”, -- driver -- should be inserted.
Line 27, “mounting” should be -- carrier --.
Line 29, after “Carrier”, -- member -- should be inserted.
Line 35, “time piece” should be -- timepiece --.
Line 61, before “driver”, -- rotatable -- should be inserted.

Column15,
Line 38, “and” should be -- said --.
Line 44, “secure” should be -- secured --.

Column 16,
Line 30, before “gear”, -- sun -- should be inserted.
Line 31, “wherein” should be -- where --.
Line 35, “of” should be -- for --.

Signed and Sealed this

Tenth Day of August, 2004

JON W. DUDAS
*Acting Director of the United States Patent and Trademark Office*